US007891152B2

(12) United States Patent
Yu

(10) Patent No.: US 7,891,152 B2
(45) Date of Patent: Feb. 22, 2011

(54) SLIDING DOOR ARRANGEMENT

(75) Inventor: Jiahong Yu, Shenzhen (CN)

(73) Assignee: Shenzhen Hongmen Science & Technology Co., Ltd., Guangdong (CN)

( * ) Notice: Subject to any disclaimer, the term of this patent is extended or adjusted under 35 U.S.C. 154(b) by 202 days.

(21) Appl. No.: 12/323,962

(22) Filed: Nov. 26, 2008

(65) Prior Publication Data

US 2009/0241427 A1 Oct. 1, 2009

(30) Foreign Application Priority Data

Mar. 28, 2008 (CN) ..... 2008 1 0066257

(51) Int. Cl.
*E04C 2/38* (2006.01)

(52) U.S. Cl. ..... 52/657; 52/291

(58) Field of Classification Search ..... 52/223.1, 52/223.6, 223.8, 223.12, 291, 640, 656.1, 52/656.8, 695, 657, 656.4, 207, 455, 456, 52/457, 458; 256/73; 49/404, 413, 453, 49/463, 464, 380, 501

See application file for complete search history.

(56) References Cited

U.S. PATENT DOCUMENTS

| | | | | | |
|---|---|---|---|---|---|
| 202,722 | A * | 4/1878 | Harrington | 49/381 |
| 515,340 | A * | 2/1894 | Judd | 52/291 |
| 1,114,479 | A * | 10/1914 | Iven | 256/31 |
| 1,235,152 | A * | 7/1917 | Swan | 49/388 |
| 1,298,072 | A * | 3/1919 | McNabney | 256/73 |
| 1,923,961 | A * | 8/1933 | Wood | 52/291 |
| 2,144,528 | A * | 1/1939 | Warren | 52/675 |
| 2,434,447 | A * | 1/1948 | Van Horn | 49/160 |
| 2,597,786 | A * | 5/1952 | Fontaine | 52/798.1 |
| 2,686,579 | A * | 8/1954 | Johannsen | 52/579 |
| 2,732,919 | A * | 1/1956 | Johnson, Jr. | 49/372 |
| 3,367,080 | A * | 2/1968 | McClelland | 52/645 |
| 4,083,535 | A * | 4/1978 | Britt | 256/24 |
| 4,167,088 | A * | 9/1979 | Governale | 52/207 |
| 4,618,067 | A * | 10/1986 | Cohn et al. | 220/1.5 |
| 4,628,638 | A * | 12/1986 | Elko et al. | 49/426 |
| 5,279,088 | A * | 1/1994 | Heydon | 52/241 |
| 5,575,321 | A * | 11/1996 | Currier | 160/90 |
| 5,862,639 | A * | 1/1999 | Abou-Rached | 52/223.6 |
| 6,192,637 | B1 * | 2/2001 | Boilen et al. | 52/167.3 |
| 6,941,718 | B1 * | 9/2005 | diGirolamo et al. | 52/695 |
| 2002/0129569 | A1 * | 9/2002 | Collins | 52/204.61 |
| 2003/0056465 | A1 * | 3/2003 | Banicevic et al. | 52/784.1 |

* cited by examiner

*Primary Examiner*—Robert J Canfield
*Assistant Examiner*—Babajide Demuren
(74) *Attorney, Agent, or Firm*—J.C. Patents

(57) ABSTRACT

A sliding door arrangement includes a plurality of door units; at least one upright post connecting adjacent door units; a lower beam located at the bottom of and connected with the upright post; and a plurality of cross rod assemblies disposed at one side or both sides of the door units respectively to adjust the tightness of the sliding door arrangement. The sliding door arrangement of the present invention can be packaged and transported in separate parts and then quickly and conveniently assembled on site. In addition, the sliding door arrangement of the present invention is perfectly integral and decorative and provides sufficient strength.

9 Claims, 5 Drawing Sheets

SLIDING DOOR ARRANGEMENT

CROSS-REFERENCE TO RELATED APPLICATION

This application claims the priority benefit of Chinese application serial no. 200810066257.1, filed Mar. 28, 2008. The entirety of the above-mentioned patent application is hereby incorporated by reference herein and made a part of specification.

BACKGROUND OF THE INVENTION

1. Field of the Invention

The present invention relates to a sliding door which is opened or closed in an integrally sliding way, particularly relates to a door arrangement for a sliding door, which is convenient to transport and assembly, and which is perfectly integral and decorative.

2. Discussion of the Related Art

Doors are important component parts for buildings and public facilities. Doors are also the most frequently used architectural components. Common doors include doors opened pivotally, telescopic doors opened or closed telescopically as yard doors and sliding doors opened in a push-pull way as yard doors. Conventional sliding door consists of a door body and a roller mounted at the bottom of the door body, and requires sliding track to be laid on the ground. With external force, the sliding door can slide on the sliding track through the roller at the bottom thereof. The door bodies for conventional sliding doors are all fixed structures. The connections between the door frames and the vertical bars and the connections between the door frames and the upper beam and the lower beam are made by welding or riveting. Sliding doors are usually large in size, some even to the extent of dozens of meters in length and/or width. Due to the fixed structure of the conventional sliding doors, these doors cannot be transported in separate parts and assembled on site later, thus cause great inconvenience and cost increase in both packaging and transportation.

SUMMARY OF THE INVENTION

An object of the present invention is to provide a sliding door arrangement, which can be packaged and transported in separate parts and then quickly and conveniently assembled on site.

Another object of the present invention is to provide a sliding door arrangement which is perfectly integral and decorative and provides sufficient strength.

To achieve the above object, the present invention provides a sliding door arrangement which comprises: a plurality of door units; at least one upright post, connecting two adjacent door units; a lower beam, located at a bottom of the lower beams and connected with the upright post; and a plurality of cross rod assemblies, disposed at one side or both sides of each door unit respectively to adjust a tightness of the sliding door arrangement.

The door units are grid type, to be specific, the door units are formed by connecting an outer frame and a plurality of vertical rods which are arranged vertically and spaced apart.

The sliding door arrangement further comprises: an upper beam, located on a top of the sliding door arrangement; and a plurality of connectors, connecting the lower beam, the upper beam and the cross rod assembly with the upright post.

The upright post is hollow in its center and comprises: a plurality of positioning slots on right side and left side thereof for engaging respective door units; an upper connecting hole near the upper end thereof; a lower connecting hole near the lower end thereof; an upper opening at the upper end thereof for connecting the upright post with the upper beam; a lower opening at the lower end thereof for connecting the upright post with the lower beam.

The lower beam generally has an inverted U shape cross-section, and comprises: a groove on its top surface along the longitudinal direction, to engage with the door unit; and a plurality of connecting holes disposed corresponding to the position of the upright post, to connect the lower beam with the upright post.

The connector includes a plurality of connecting sleeves, with a shape conforming to the internal shape of the upright post for inserting therein. The connecting sleeve comprises: an opening, facing to the upper opening or the lower opening of the upright post when assembled; a bottom, having a plurality of vertical connecting holes thereon; at least two sidewalls, having a plurality of horizontal connecting holes thereon for connecting with the rods.

The connector further includes: a plurality of connecting blocks, disposed in the upper beam and the lower beam corresponding to the positions of the connecting sleeves respectively, and having a plurality of threaded holes thereon corresponding to the plurality of vertical connecting holes of the connecting sleeves; and a plurality of connecting bolts, each with one end disposed in corresponding connecting sleeve and the other end threadedly connected with the connecting block through the lower beam or the upper beam respectively, so that the lower beam and the upper beam are connected with the upright post.

Each of cross rod assemblies comprises two rods substantially diagonally disposed across the side surface of each door unit. Both ends of each rod have a rod connecting hole. The rod is connected with the upright post by a pin shaft or bolt. The pin shaft or bolt passes through the rod connecting hole, the upper connecting hole and the lower connecting hole of the upright post, and the horizontal connecting hole of the connecting sleeve respectively. Each of the two rods has a shaft hole at an intersection of two rods. Each of cross rod assemblies further comprises a center shaft assembly, for rotatablely connecting the two rods together at the intersection. Furthermore, each of the rods consists of several threadedly connected rod segments, and the revolving direction of the rod segments is configured so that the tightness of the sliding door arrangement could be adjusted by revolving corresponding rod segments.

The contribution of the present invention is in that it overcomes various defects in conventional sliding doors. Since the connections of the various members of the sliding door according to the present invention, including the connections between each door unit and the upright posts and the connections between the upright posts and the upper beam and the lower beam, are formed by insertion, these members are not only easy to be processed, but also convenient to be packaged and transported in separate parts and assembled quickly on site. Thus, the cost for packaging and transportation is saved considerably and the work efficiency is improved significantly. In addition, the cross rods disposed at both sides of the sliding door arrangement which are used to adjust the tightness thereof ensure the strength of the sliding door arrangement, and also enhance the decorativeness and the aesthetic appearance of the sliding door arrangement.

DESCRIPTION OF THE PREFERRED EMBODIMENTS

The following embodiments are intended to further explain and illustrate the present invention, but not intended to limit the present invention in any way.

Figure 1:
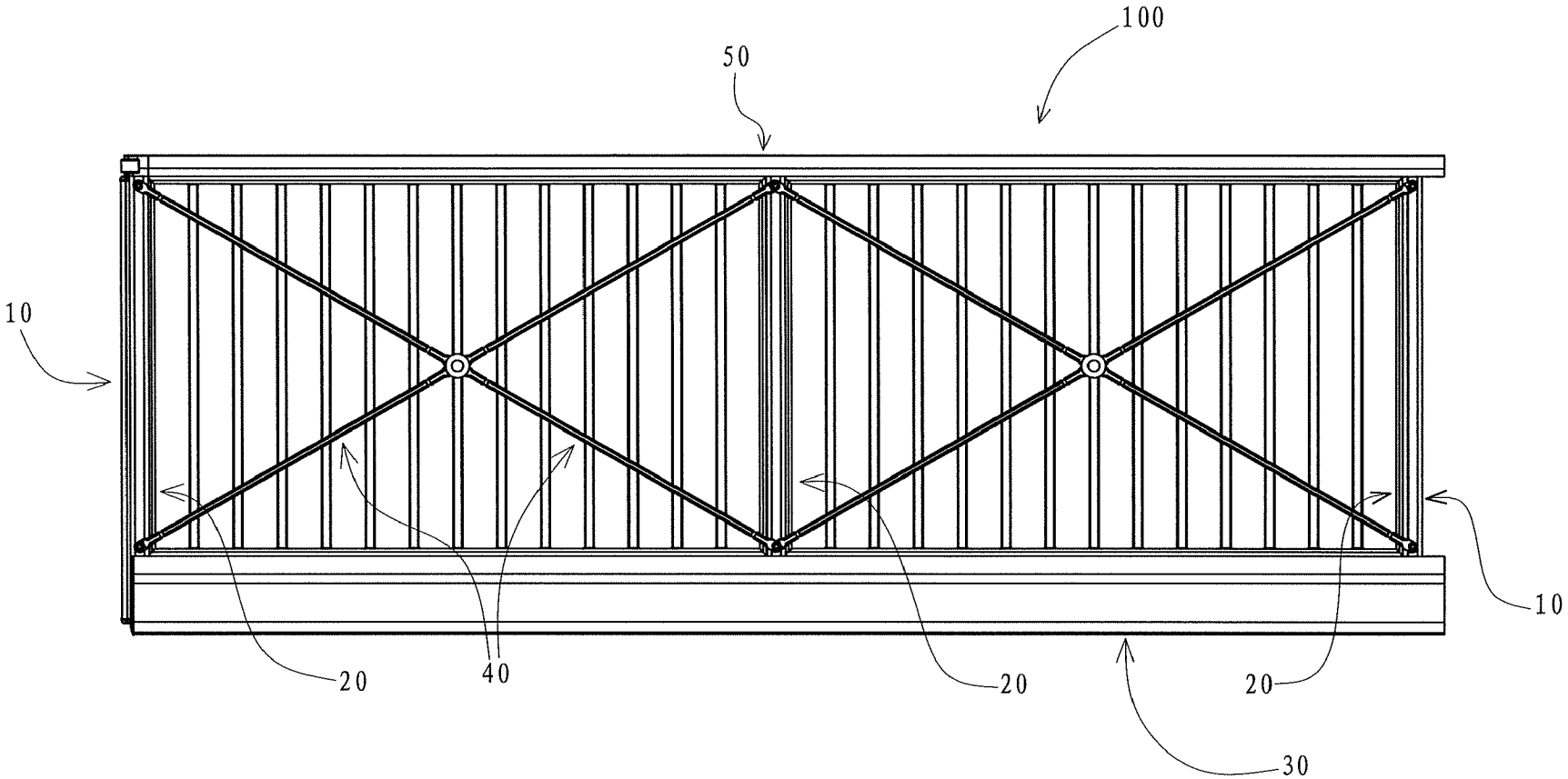
FIG. 1 is a schematic diagram illustrating an exemplary sliding door arrangement according to one embodiment of the present invention.

Referring to FIG. 1 and FIG. 2, the sliding door arrangement according to the present invention includes a plurality of door units 10, a plurality of upright posts 20, a lower beam 30, cross rod assemblies 40 and connectors 60. The sliding door arrangement may selectively include an upper beam 50. The door unit 10 is grid type, to be specific, the door unit 10 is a grid type part formed by connecting an outer frame 11 of aluminum profile and a plurality of vertical rods 12 of hollow aluminum tube which are arranged vertically and spaced apart from each other, and the door unit 10 can be packaged and transported separately. The sliding door arrangement 100 of the present invention is generally configured by connecting the door units by the plurality of the upright posts. Though only two door units are shown in FIG. 1 and FIG. 2, the number of the door units is not limited to this; obviously, the number of the door units depends on the actual length and design requirements of the sliding door arrangement.

Figure 2A:
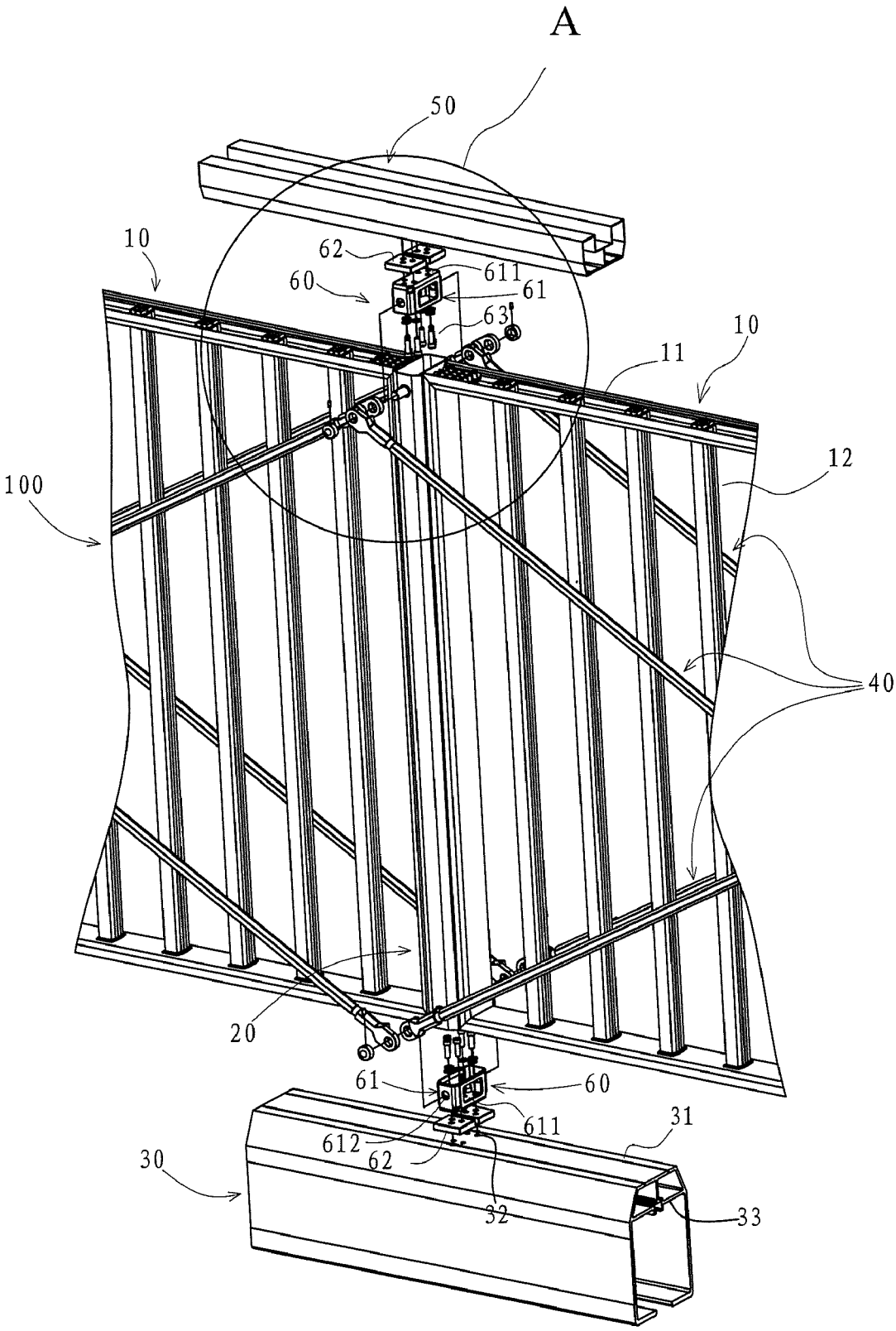
FIG. 2A is an exploded view of the sliding door arrangement of FIG. 1.
Figure 2B:
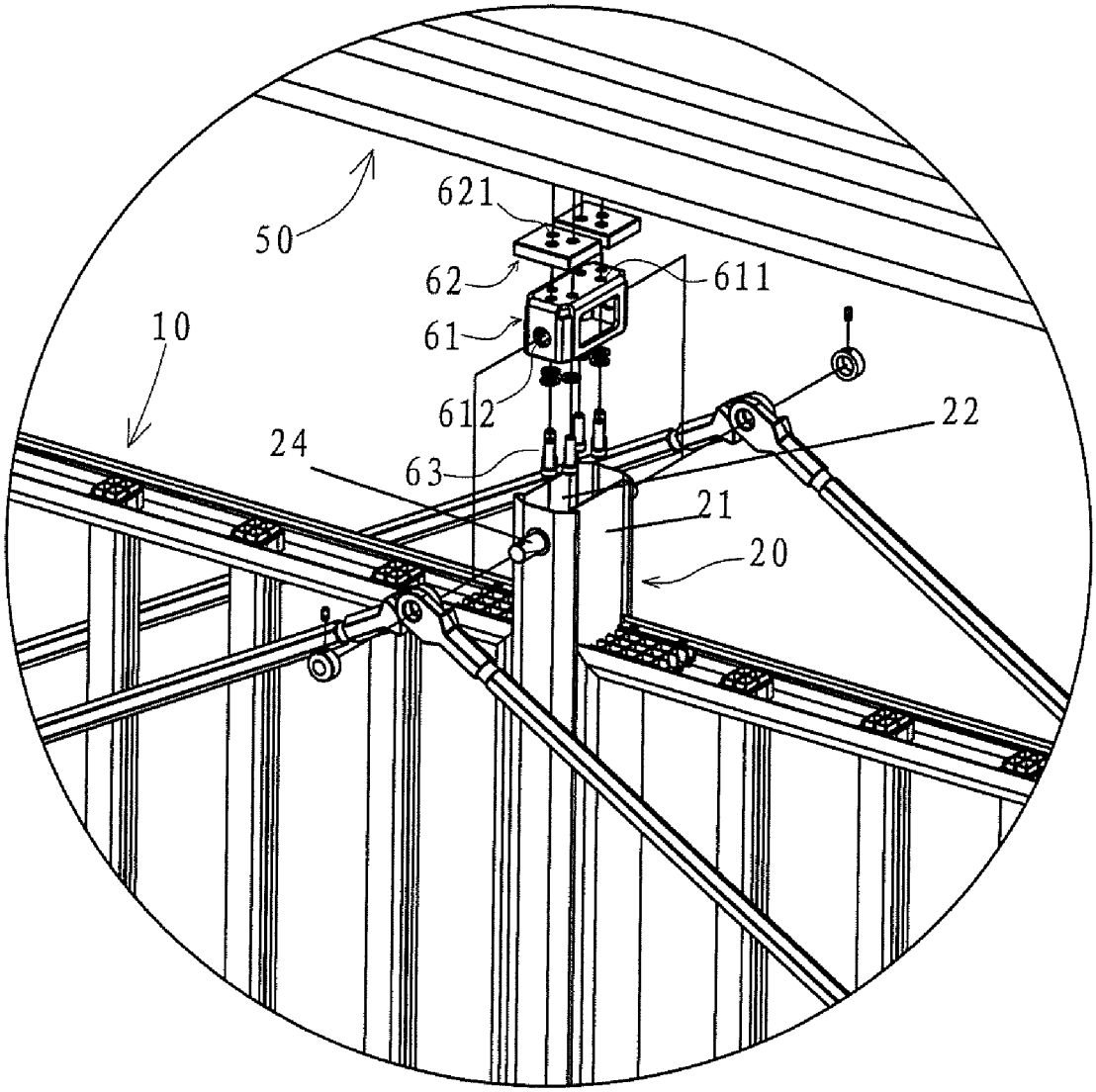
FIG. 2B is an enlarged view of portion A in FIG. 2A.

As shown in FIG. 2B, the upright post 20 is a hollow tubular body of aluminum profile with a substantially rectangular cross section, the height of which is about the same as that of the sliding door arrangement. The upright post has positioning slots 21 on the right side and the left side, so that the right side and the left side of the door unit 10 can be positioned in these slots. The upright post 20 has an upper opening 22 and a lower opening 23 at the upper end and the lower end respectively to connect with the upper beam 50 and the lower beam 30. The upright post 20 has an upper connecting hole 24 near the upper end thereof for connecting the cross rod assembly to the upright post. The upright post 20 further has a lower connecting hole 25 near the lower end thereof for connecting the cross rod assembly to the upright post.

In an embodiment of the present invention, an upper beam 50, which is a hollow tubular body of aluminum profile with U shape cross section, is mounted on the top of the sliding door arrangement 100. The upper beam 50 has connecting holes (not shown) on the lower sidewall at positions corresponding to the upright posts 20 in order to connect with the upright posts 20 through connectors 60.

Figure 3:
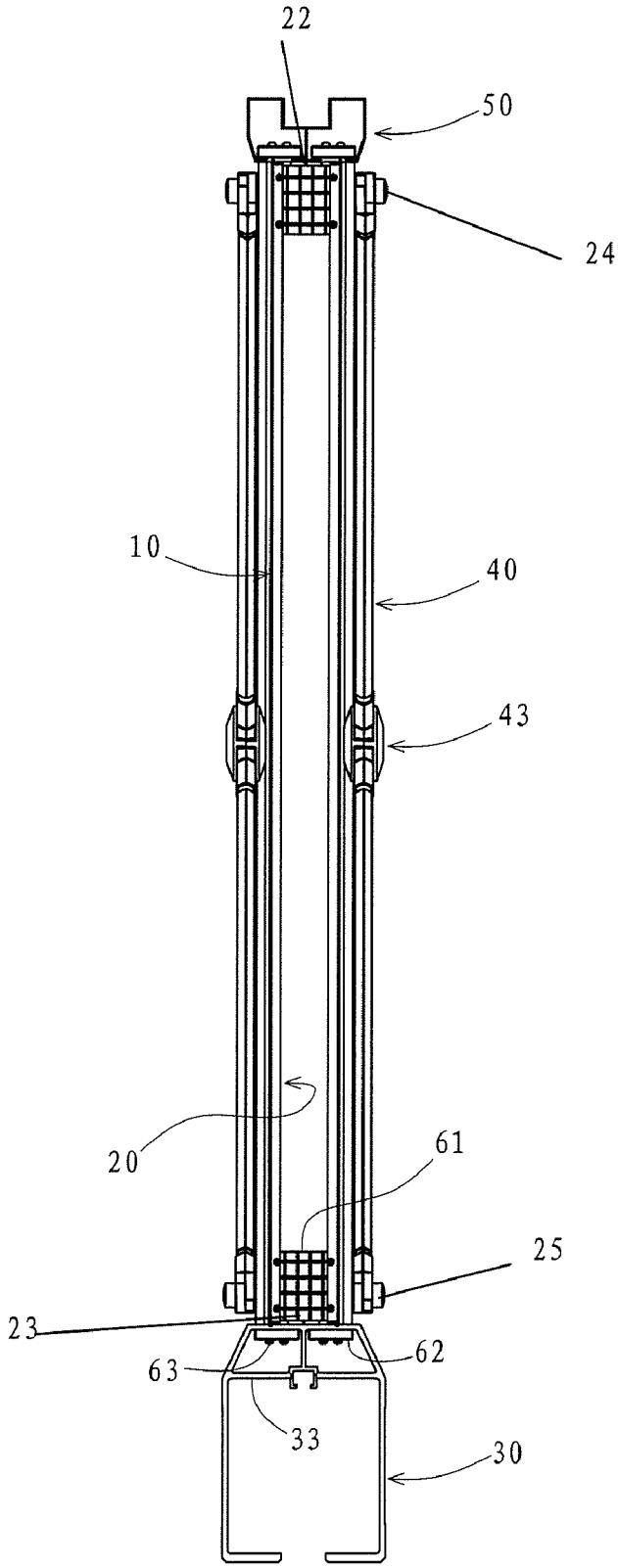
FIG. 3 is a cross-sectional side view of FIG. 1.

As show in FIG. 2A, the lower beam 30, which is made of aluminum profile, with an approximately rectangular cross-section (also could be regarded as an inverted U shape cross-section), is mounted at the bottom of the sliding door arrangement 100. As shown in FIG. 3, a spacer plate 33, which has an inverted T shape, is disposed in the lower beam near the upper portion thereof in order to increase the strength of the lower beam. The lower beam has two grooves on the top surface along the longitudinal direction, which are corresponding to a wall thickness of the outer frame 11 of the door units, so that the outer frame 11 of the plurality of door units 10 can be embedded and engaged in these grooves. The lower beam 30 has a plurality of connecting holes 32 on its top surface at positions corresponding to the upright posts 20 and connects with the upright posts 20 though connectors 60.

As shown in FIG. 2A, FIG. 2B and FIG. 3, the connector 60 includes a connecting sleeve 61, at least a connecting block 62 and several connecting bolts 63. As shown in FIG. 2A, the connecting sleeve 61 is in a rectangular shape conforming to the internal shape of the upright post 20 for inserting therein. For example, the connecting sleeve 61 is made of plastic material. The connecting sleeve 61 includes an opening, a bottom and at least two sidewalls (not labeled). The opening faces to the upper opening 22 or the lower opening 23 of the upright post 20 when assembled. The bottom has a plurality of vertical connecting holes 611 thereon. The sidewalls have a plurality of horizontal connecting holes 612 thereon for connecting with the rods 41,42(below mentioned). The connecting sleeve for connecting the lower beam 30 is opened upward, while the connecting sleeve for connecting the upper beam 50 is opened downward.

In FIG. 2B, the connecting block 62 which is a plate like body has a plurality of threaded holes 621 corresponding to the plurality of vertical connecting holes 611 on the connecting sleeve 61. As shown in FIG. 3, the connecting block 62 is disposed in the lower beam 30 or the upper beam 50 at the position corresponding to the upright post 20 respectively, where the connecting block in the lower beam 30 is mounted in the top portion inside of the lower beam, while the connecting block in the upper beam 50 is mounted at the bottom of the upper beam, and the connecting block is mounted into the upper beam or lower beam by a special fixture. When the lower beam 30 and the upper beam 50 are connected with the upright post 20, one end of the connecting bolt 63 with a screw cap is disposed in the connecting sleeve 61, while the other end passes through the lower beam 30 or the lower beam 50 to threadedly connect with the connecting block 62, so that the lower beam 30 and the upper beam 50 could connect with the upright post.

Figure 4B:
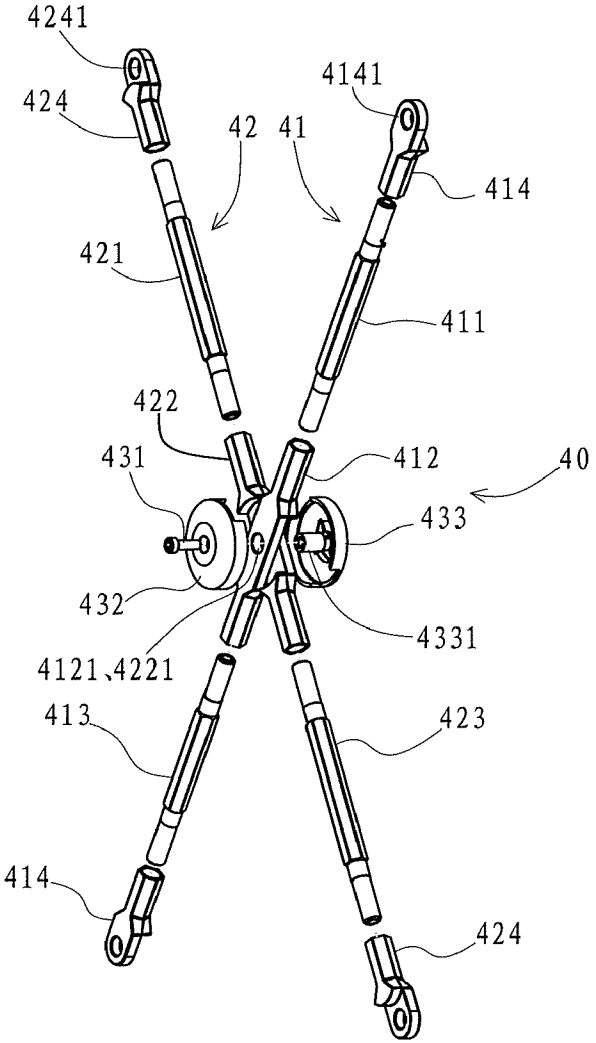
FIG. 4B is an exploded view illustrating the parts of the rod assembly.
Figure 4A:
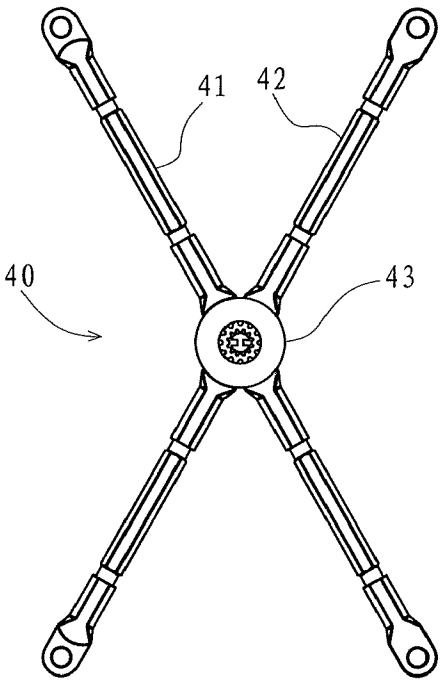
FIG. 4A is a schematic diagram illustrating a rod assembly used in the sliding door arrangement of FIG. 1.

As shown in FIG. 2A, FIG. 2B and FIG. 3, each door unit 10 is equipped with a pair of cross rod assemblies 40 on the front side and the rear side respectively to adjust the degree of tightness. The rod assembly, as shown in FIG. 1, FIG. 4A and FIG. 4B, includes two rods 41, 42 and a center shaft assembly 43. Refer to FIG. 4B, the rods 41, 42 are formed by threadedly connecting several rod segments made of hollow tube. In this example, each of the rods 41, 42 is formed by threadedly connecting three rod segments 411, 412, 413 and 421, 422, 423 respectively. The two ends of each of the rod segments 411, 413 and 421, 423 located at the edges have threaded portions with a smaller external diameter than an internal diameter of the rod segments 412 and 422 located at center. The revolving directions of the external threads at the two ends of each of the rod segments 411, 413 and 421, 422 are opposite, that is, if one end revolves to the left, then the other end revolves to the right. Correspondingly, both ends of each of the rod segments 412, 412 located at the center have internal threads that revolve in the same direction as the external threads of the rod segments 411, 413 and 421, 423 and threadedly connect with them respectively. Rod segments 412, 422 have shaft holes 4121, 4221 respectively at the intersection of two rods 41, 42. In this example, both ends of each of rods 41, 42 are provided with adapters 414,424 respectively. The adapters 414 and 424 have rod connecting holes 4141 and 4241 respectively to connect with the upright post 20. The adapters 414 and 424 have internal threads that revolve in the same direction as the external threads of the rod segments 411, 413 and 421, 423 and threadedly connect with them respectively. As shown in FIG. 1, the rods 41, 42 are diagonally connected on the side surface of each door unit, the upper end and the lower end of each of the rods 41, 42 connecting with the upright posts 20 by a shaft pin 44 passing through the rod connecting holes 4141, 4241 and the upper connecting hole 24 and lower connecting hole 25 of the upright post. The center shaft assembly 43 is rotatablely connected at the intersection of two rods. The center shaft assembly 43, as shown in FIG. 4A and FIG. 4B, includes a center shaft 431, a front shaft seat 432 and a rear shaft seat 433, wherein, the front shaft seat 432 and the rear shaft seat 433 are in cover shape with shaft holes, and function to support and decorate the center shaft. A shaft sleeve 4331 is disposed in the rear shaft seat 433 and passes through the shaft holes 4121, 4221. The center shaft 431 passes through the front shaft seat 432 and the shaft sleeve 4331 of the rear shaft seat 433 and is fixed by at least a bolt, so that the rods 41, 42 can rotate around the center shaft 431. The degree of tightness of the rods 41, 42 is adjustable. When adjusting, clamp any of the rod segments 411, 413 and 421, 423 of the rods 41 or 42 with a specific tool and rotate to simultaneously tighten or release the rods 41 or 42 to a suitable degree of tightness.

Referring to FIG. 2A and FIG. 2B, when assembling the sliding door arrangement of the present invention, firstly, engage each door unit 10 with the upright posts 20 on both sides; next, connect the upper end and the lower end of each upright post 20 with the upper beam 50 and the lower beam 30 through the connectors 60 respectively; then connect both ends of each of the rods 41, 42 with the upright posts 20 respectively by the shaft pin 44 through connectors 60.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims.

The invention claimed is:

1. A sliding door arrangement, comprising:

a plurality of door units;

at least one upright post, connecting two adjacent door units;

a lower beam, located at a bottom of the upright post and connected therewith;

a plurality of cross rod assemblies, disposed at one side or both sides of each of the door units respectively to adjust a tightness of the sliding door arrangement;

an upper beam located on a top of the sliding door arrangement; and a plurality of connectors connecting the lower beam, the upper beam and the cross rod assembly with the upright post respectively, wherein the upright post is hollow in a center thereof and comprises:

a plurality of positioning slots defined on right side and left side of the upright post for engaging respective door units;

an upper connecting hole near the upper end of the upright post for connecting the cross rod assembly thereto;

a lower connecting hole near the lower end of the upright post for connecting the cross rod assembly thereto;

an upper opening at the upper end of the upright post for connecting the upper beam therewith; and a lower opening at the lower end of the upright post for connecting the lower beam therewith.

2. The sliding door arrangement according to claim 1, wherein the door units are grid type.

3. The sliding door arrangement according to claim 2, wherein the door units are formed by connecting an outer frame and a plurality of vertical rods which are arranged vertically and spaced apart.

4. The sliding door arrangement according to claim 3, wherein, the lower beam generally has an inverted U shape cross-section, and comprises:

a groove on its top surface along the longitudinal direction, to engage with the door unit; and a plurality of connecting holes disposed corresponding to the position of the upright post, for connecting the lower beam with the upright post.

5. The sliding door arrangement according to claim 4, wherein the connector comprises:

a plurality of connecting sleeves, with a shape conforming to the internal shape of the upright post for inserting therein, the connecting sleeves comprising:

an opening, facing to the upper opening or the lower opening of the upright post when assembled;

a bottom, having a plurality of vertical connecting holes thereon;

at least two sidewalls, having a plurality of horizontal connecting holes thereon for connecting with the rods, a plurality of connecting blocks, disposed in the upper beam and the lower beam corresponding to the positions of the connecting sleeves respectively, and having a plurality of threaded holes thereon corresponding to the plurality of vertical connecting holes of the connecting sleeves; and a plurality of connecting bolts, each with one end disposed in corresponding connecting sleeve and the other end threadedly connected with the connecting block through the lower beam or the upper beam respectively, so that the lower beam and the upper beam are connected with the upright post.

6. The sliding door arrangement according to claim 5, wherein each of cross rod assemblies comprises:

two rods, substantially diagonally disposed across the side surface of each door unit; and a center shaft assembly, for rotatablely connecting the two rods together at the intersection, wherein both ends of each rod have a rod connecting hole, and the rods are connected with the upright post by a pin shaft or bolt, the pin shaft or bolt passing through the rod connecting holes and the upper connecting hole and the lower connecting hole of the upright post respectively, each of the two rods having a shaft hole at an intersection of two rods.

7. The sliding door arrangement according to claim 1, wherein each of the cross rod assemblies comprises:

two rods, substantially diagonally disposed across the side surface of each door unit, both ends of each rod connected to the upright post; and a center shaft assembly, for rotatablely connecting the two rods together at an intersection of the two rods, wherein each of the rods consists of several threadedly connected rod segments, and each of the revolving direction of the rod segments is configured so that the tightness of the sliding door arrangement could be adjusted by revolving corresponding rod segments.

8. The sliding door arrangement according to claim 7, wherein the center shaft assembly comprises:

a center shaft;

a front shaft seat; and a rear shaft seat with a shaft sleeve, the front shaft seat and the rear shaft seat being in cover shape with shaft holes, and functioning to support and decorate the center shaft, wherein the shaft sleeve passes through the shaft holes, and the center shaft passes through the front shaft seat and the shaft sleeve of the rear shaft seat and is fixed by at least a bolt, so that the rods could rotate around the center shaft.

9. A sliding door arrangement, comprising:

a plurality of door units, the door unit being grid type;

at least one upright post, being hollow in its center;

a lower beam, located at a bottom of the upright post and connected therewith; and a plurality of cross rod assemblies, disposed at one side or both sides of each door unit respectively to adjust the tightness of the sliding door arrangement, wherein, the upright post comprises:

a plurality of positioning slots on right side and left side thereof for engaging respective door units;

an upper connecting hole near the upper end thereof for connecting the cross rod assembly to the upright post;

a lower connecting hole near the lower end thereof for connecting the cross rod assembly to the upright post;

a lower opening at the lower end thereof for connecting the upright post with the lower beam; and a plurality of connectors, connecting the lower beam and the cross rod assembly with the upright post, wherein each of the cross rod assemblies comprises:

two rods, substantially diagonally disposed across the side surface of each door unit, both ends of each rod connected to the upright post; and a center shaft assembly, for rotatablely connecting the two rods together at an intersection of the two rods.

* * * * *